US006428185B1

(12) United States Patent
Lin

(10) Patent No.: US 6,428,185 B1
(45) Date of Patent: Aug. 6, 2002

(54) DECORATIVE LIGHTING DEVICE FOR FESTIVAL OR THE LIKE

(76) Inventor: Yu Chuan Lin, P.O. Box 10-69, Chong Ho, Taipei (TW), 235

( * ) Notice: Subject to any disclaimer, the term of this patent is extended or adjusted under 35 U.S.C. 154(b) by 0 days.

(21) Appl. No.: 09/828,729

(22) Filed: Apr. 6, 2001

(51) Int. Cl.[7] ..... F21V 33/00

(52) U.S. Cl. ..... 362/253; 362/96; 362/806; 40/439

(58) Field of Search ..... 362/96, 253, 294, 362/373, 806, 352; 40/406, 407, 409, 412, 422, 439, 441, 477, 480

(56) References Cited

U.S. PATENT DOCUMENTS 2,498,270 A * 2/1950 Hawley ..... 40/439
5,683,167 A * 11/1997 Tarlow ..... 362/373
6,089,726 A * 7/2000 Eldridge, Jr. ..... 362/96
6,186,857 B1 * 2/2001 Gazit et al. ..... 40/412
6,279,254 B1 * 8/2001 Gill et al. ..... 40/439

* cited by examiner

*Primary Examiner*—Y. My Quach-Lee

(57) ABSTRACT

A lighting device includes a decorative sleeve member disposed on a base, one or more light devices may be used for lighting the interior of the decorative sleeve member, and a fan device may be used to generate an air stream to flow through the interior of the decorative sleeve member and to oscillate or fluctuate the decorative sleeve member for generating the other decorative effects. A protective net member may be secured to the fan device for protecting the fan device. The decorative sleeve member may be clamped onto the base or a housing with a resilient belt.

14 Claims, 3 Drawing Sheets

DECORATIVE LIGHTING DEVICE FOR FESTIVAL OR THE LIKE

BACKGROUND OF THE INVENTION

1. Field of the Invention

The present invention relates to a lighting device, and more particularly to a lighting device for festival decorative purposes.

2. Description of the Prior Art

Typically, excavated pumpkins or skulls are used for decorative purposes in the Halloween festival or in the All Saints' Day. Some people may put the lights or the candles in the pumpkin heads or in the skulls for lighting purposes. However, it is inconvenient to make such decorative lighting devices.

The present invention has arisen to mitigate and/or obviate the afore-described disadvantages of the conventional lighting devices.

SUMMARY OF THE INVENTION

The primary objective of the present invention is to provide a lighting device for generating specialized lighting effects and for festival decorative purposes.

In accordance with one aspect of the invention, there is provided a lighting device comprising a base, a decorative sleeve member disposed on the base, means for blowing an interior of the decorative sleeve member, and means for lighting the decorative sleeve member and for generating a specialized fluctuating and lighting effect and for festival decorative purposes.

The base includes a plurality of orifices formed therein for air circulation and for heat dissipating purposes.

The base includes a bottom peripheral portion having a peripheral flange radially extended outward from the bottom peripheral portion thereof for forming a stable supporting structure to the lighting device.

A cylindrical receptacle is further provided on top of the base and includes an inner peripheral flange extended radially inward therefrom, the blowing means includes a fan device received in the receptacle and engaged on the inner peripheral flange.

The receptacle includes four slots formed therein, the fan device includes four corners engaged in the slots of the receptacle.

The lighting means includes at least one light device supported in the base and received in the decorative sleeve member for lighting the decorative sleeve member. The lighting means includes at least one socket provided in the base for receiving the at least one light device. The lighting means includes a bar secured in the base, the at least one socket is secured on the bar for supporting the at least one light device.

A housing is further provided and secured on top of the base, such as secured on the receptacle, the decorative sleeve member is secured on top of the housing. The housing includes an enlarged bottom portion for engaging onto the receptacle.

A screen member is further provided and disposed in the housing for filtering purposes.

A device is further provided for securing the decorative sleeve member on the housing and includes a resilient belt engaged on the decorative sleeve member for engaging and securing onto the housing.

A protective net member is further provided and secured to the fan device for protecting the fan device. The decorative sleeve member includes at least one tube extended therefrom.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
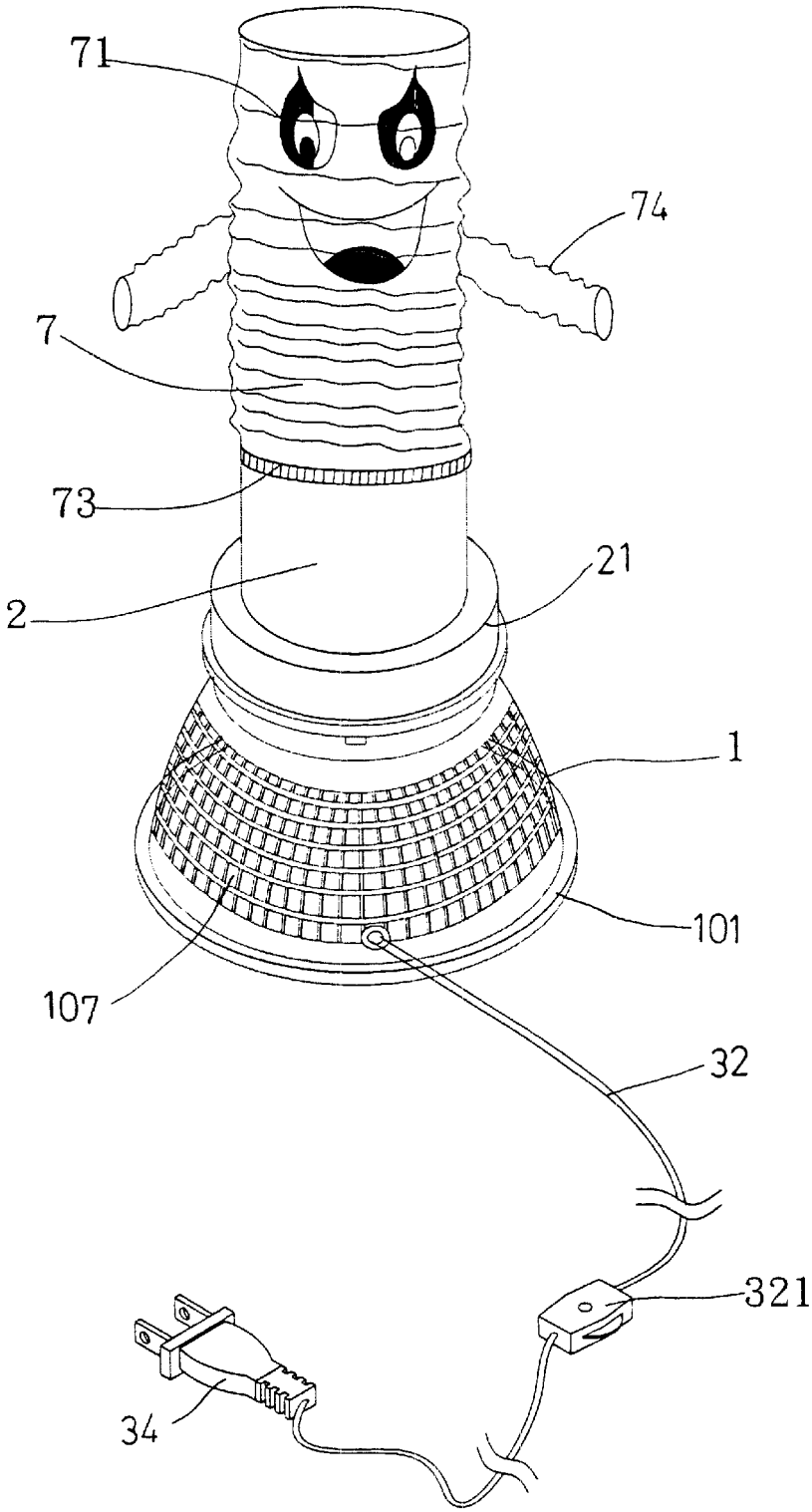
FIG. 1 is a perspective view of a lighting device in accordance with the present invention.
Figure 2:
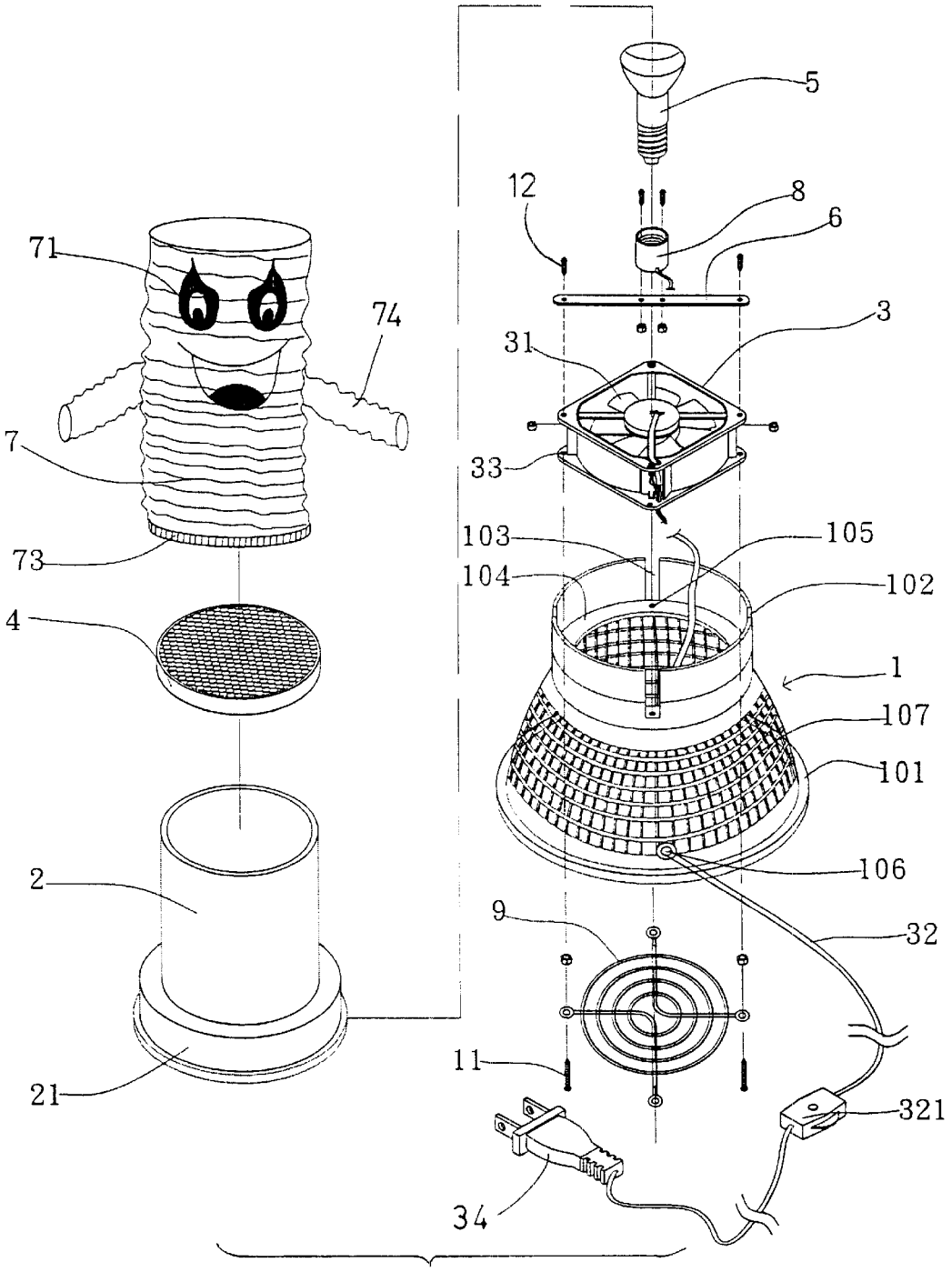
FIG. 2 is an exploded view of the lighting device.

Referring to the drawings, and initially to FIGS. 1 and 2, a lighting device in accordance with the present invention comprises a cone-shaped base 1 including a peripheral flange 101 radially extended outward from the bottom thereof for forming a stable supporting structure, and including a number of orifices 107 formed therein for air circulation purposes or for heat dissipating purposes, and including a hole 106 formed in the bottom thereof for receiving an electric wire 32 or the like, and including a receptacle, such as a cylindrical-shaped receptacle 102 disposed or provided on top thereof or extended upward from the upper portion thereof, for supporting the other elements or parts. The receptacle 102 includes one or more, such as four slots 103 formed in the peripheral portion thereof, and includes an inner peripheral flange 104 extended radially inward from the bottom portion thereof and having one or more holes 105 formed in the inner peripheral flange 104, and preferably aligned with the slots 103 thereof.

A fan device 3 is received in the cylindrical receptacle 102 and engaged on and secured to the inner peripheral flange 104 of the cylindrical receptacle 102 with fasteners 11 or the like, and includes a fan member 31 electrically coupled to a socket 90 (FIG. 3) with an electric wire or cable 32 and/or a switch 321 for allowing the fan member 31 to be energized and actuated. The fan device 3 may also be actuated or controlled by the switch 321, for example. The fan device 3 includes one or more holes 33 formed therein for receiving the fasteners 11 which may secure the fan device 3 to the receptacle 102 and the base 1. A protective net member 9 is secured to the bottom of the fan device 3, or secured to the bottom of the inner peripheral flange 104 of the cylindrical receptacle 102 with the fasteners 11, for protecting the fan device 3 and for preventing the fan device 3 from being damaged by the particles drawn by the fan device 3. The fan device 3 may generate an air stream to flow upward and outward of the cylindrical receptacle 102. The fan device 3 includes four corners engaged and secured in the slots 103 of the cylindrical receptacle 102, such that the fan device 3 may be solidly retained in the cylindrical receptacle 102.

A bar 6 is secured on top of the fan device 3 or secured on the receptacle 102 with fasteners 12 or the like. A socket 8 is secured on top of the bar 6, and a light device or a light bulb 5 is plugged in the socket 8. The socket 8 may also be coupled to the socket 90 with the electric wire 32. A housing 2 includes an enlarged bottom portion 21 for engaging onto and securing to the cylindrical receptacle 102, by such as a force-fitted engagement. A screen 4 is disposed in the housing 2 for protective or for filtering purposes.

A decorative member, particularly a decorative spatial or cylindrical or sleeve member 7 includes a resilient peripheral strap or belt 73 provided in the bottom portion thereof for resiliently clamping and securing onto the housing 2, and includes various kinds of colors or words or patterns 71 or the like applied thereon for decorative purposes. The sleeve member 7 further includes one or more extensions or tubes 74 extended outward therefrom and having a hollow interior communicating with the hollow interior of the sleeve member 7, for allowing the air stream generated by the fan device 3 to flow through the sleeve member 7 and/or the tubes 74 and to fluctuate the decorative member 7, in order to generate the decorative effect. The light device 5 may be used for lighting the interior of the decorative member 7, when the light device 5 is energized, for allowing the decorative member 7 to be easily seen in the dark and for generating another decorative effect. The light device 5 may preferably generate the lights of various kinds colors for increasing the decorative effect. The switch 321 may thus be used to control the on and off and the lightness of the light device 5 and/or the fan device 3.

Figure 3:
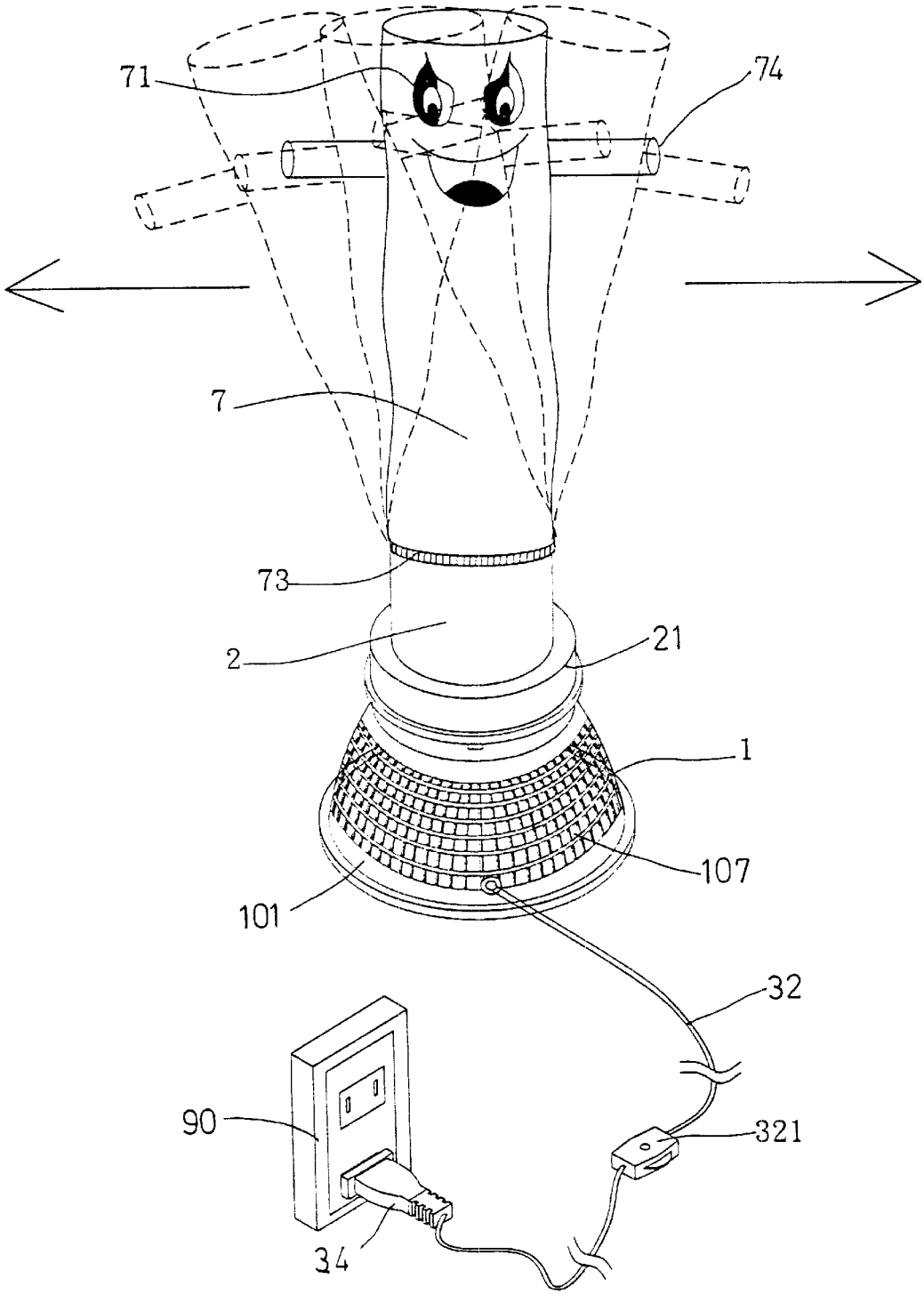
FIG. 3 is a perspective view illustrating the operation of the lighting device.

In operation, as shown in FIG. 3, the decorative sleeve member 7 and/or the tubes 74 may be blown or oscillated or fluctuated by the air streams generated by the fan device 3, and/or may be lighted by the light device 5, in order to generate the festival decorative effects. The air may be drawn into the base 1 via the orifices 107 of the base 1.

Accordingly, the lighting device in accordance with the present invention may be used for generating specialized lighting effects and for festival decorative purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lighting device comprising:

a base, a decorative sleeve member provided above said base, a cylindrical receptacle provided on top of said base, said receptacle including an inner peripheral flange extended radially inward therefrom, means for blowing an interior of said decorative sleeve member, said blowing means including a fan device received in said receptacle and engaged on said inner peripheral flange, and means for lighting said decorative sleeve member.

2. The lighting device according to claim 1, wherein said base includes a plurality of orifices formed therein for air circulation and for heat dissipating purposes.

3. The lighting device according to claim 1, wherein said base includes a bottom peripheral portion having a peripheral flange radially extended outward from said bottom peripheral portion thereof for forming a stable supporting structure to said lighting device.

4. The lighting device according to claim 1, wherein said receptacle includes four slots formed therein, said fan device includes four corners engaged in said slots of said receptacle.

5. The lighting device according to claim 1, wherein said lighting means includes at least one light device supported in said base and received in said decorative sleeve member for lighting said decorative sleeve member.

6. The lighting device according to claim 5, wherein said lighting means includes at least one socket provided in said base for receiving said at least one light device.

7. The lighting device according to claim 6, wherein said lighting means includes a bar secured in said base, said at least one socket is secured on said bar for supporting said at least one light device.

8. The lighting device according to claim 1 further comprising a housing secured on top of said base, said decorative sleeve member being secured on top of said housing.

9. A lighting device comprising:

a base, said base including a receptacle provided on top thereof, a housing secured on top of said base, said housing including an enlarged bottom portion for engaging onto said receptacle, a decorative sleeve member disposed on top of said housing, means for blowing an interior of said decorative sleeve member, said blowing means including a fan device supported in said base for generating an air stream to flow through said decorative sleeve member, and means for lighting said decorative sleeve member.

10. The lighting device according to claim 8 further comprising a screen member disposed in said housing.

11. The lighting device according to claim 8 further comprising means for securing said decorative sleeve member on said housing.

12. The lighting device according to claim 11, wherein said securing means includes a resilient belt engaged on said decorative sleeve member for engaging and securing onto said housing.

13. The lighting device according to claim 1 further comprising a protective net secured to said fan device for protecting said fan device.

14. The lighting device according to claim 1, wherein said decorative sleeve member includes at least one tube extended therefrom.

* * * * *